US006109813A

United States Patent [19]

To et al.

[11] Patent Number: 6,109,813

[45] Date of Patent: Aug. 29, 2000

[54] RING BINDER WITH DIVIDED HOUSINGS

[75] Inventors: Chun On To, Kowloon; Weng Io Ng, Quarry Bay, both of The Hong Kong Special Administrative Region of the People's Republic of China

[73] Assignee: World Wide Stationery Mfg. Co., Ltd., Kwai Chuang, The Hong Kong Special Administrative Region of the People's Republic of China

[21] Appl. No.: 09/324,660

[22] Filed: Jun. 3, 1999

[30] Foreign Application Priority Data

Jun. 5, 1998 [GB] United Kingdom ..... 9812207

[51] Int. Cl.[7] ..... B42F 3/04

[52] U.S. Cl. ..... 402/31; 402/36; 402/41; 402/26

[58] Field of Search ..... 402/26, 31, 36–42; 281/15.1, 21.1, 36

[56] References Cited

U.S. PATENT DOCUMENTS 3,270,749 9/1966 O'Connell ..... 402/36 X
5,577,852 11/1996 To ..... 402/36 X
5,816,729 10/1998 Whaley ..... 402/31

*Primary Examiner*—Willmon Fridie, Jr.
*Attorney, Agent, or Firm*—Birch, Stewart, Kolasch & Birch, LLP

[57] ABSTRACT

A ring binder includes a housing which partially covers the operating mechanism of the individual rings. The housing is formed as a plurality of individual or discrete housing segments, with a separate housing segment being provided for each of the rings.

18 Claims, 3 Drawing Sheets

RING BINDER WITH DIVIDED HOUSINGS

BACKGROUND OF THE INVENTION

1. Field of the Invention

The invention relates to a ring binder, particularly to a ring binder for use in a binder such as a folder, folio, or the like for loose-leaf papers.

2. Description of the Background Art

In the past, such binders have an operating mechanism comprising two plates which are pivotably mounted with respect to one another with an over-center action so that the ring comprising two ring parts carried by respective plates, can be opened and closed. The mechanism is housed in a continuous housing which encloses the plates from one end to the other. However, this housing is expensive to product and also adds to the weight of the binder.

SUMMARY OF THE INVENTION

It is accordingly an object of the present invention to seek to mitigate these disadvantages. According to a first aspect of the invention, a ring binder is provided comprising a plurality of discrete housings for an operating mechanism thereof. There may be an elongate element with the housings being spaced apart along the length thereof. This provides for secure holding of papers in a binder. There may be three housings. This provides for positive paper holding, particularly where there may be a housing at each end of the element and one or more intermediate the length thereof.

Each housing may be associated with a respective ring of the ring binder. This provides for positive protection of the operating mechanism at the rings. Each housing may comprise a slot for accommodating a respective ring part of a ring. This allows for opening and closing of the ring. Each housing may comprise a seat part for receiving a part of the operating mechanism. This assists in operation, particularly when the seat part may comprise a folded-over edge of the housing to provide a bearing about which a pivotable carrier rail of the operating mechanism can pivot.

At least one housing may comprise fastening means for securing the ring binder to a binder cover. The securing means may comprise a hollow rivet. This provides a relatively simple construction.

According to a second aspect of the invention, a binder is provided including a ring binder as hereinbefore defined.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
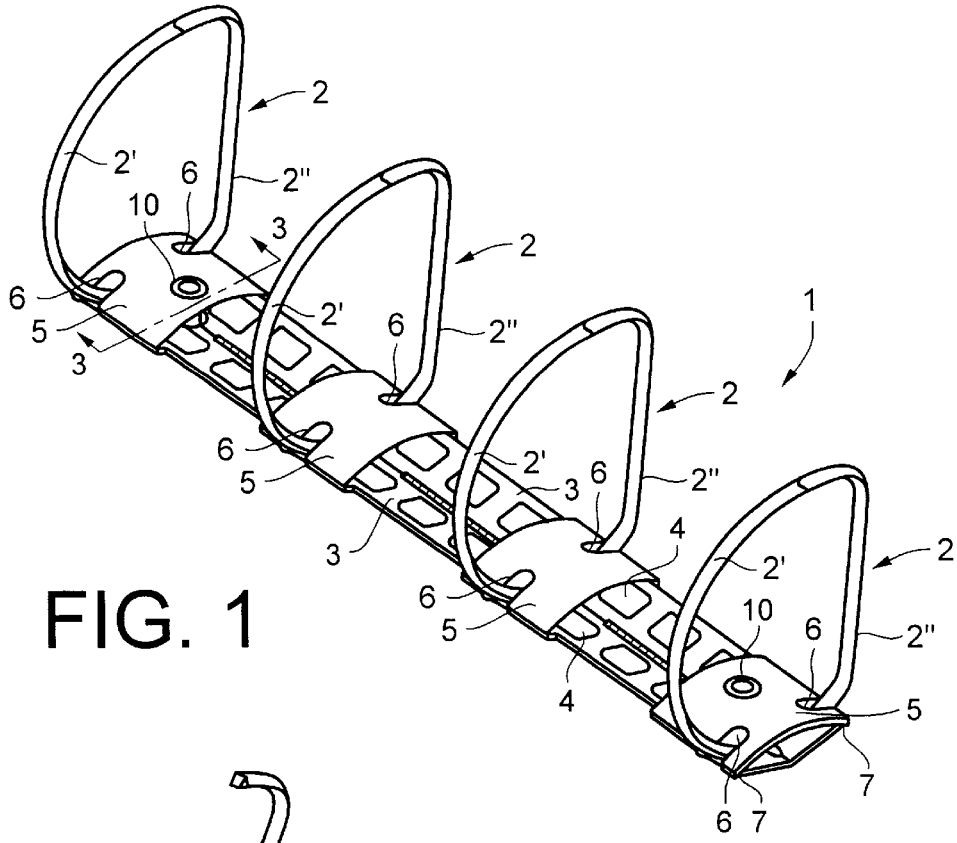
FIG. 1 is a perspective view of a ring binder according to the invention in a closed position.
Figure 2:
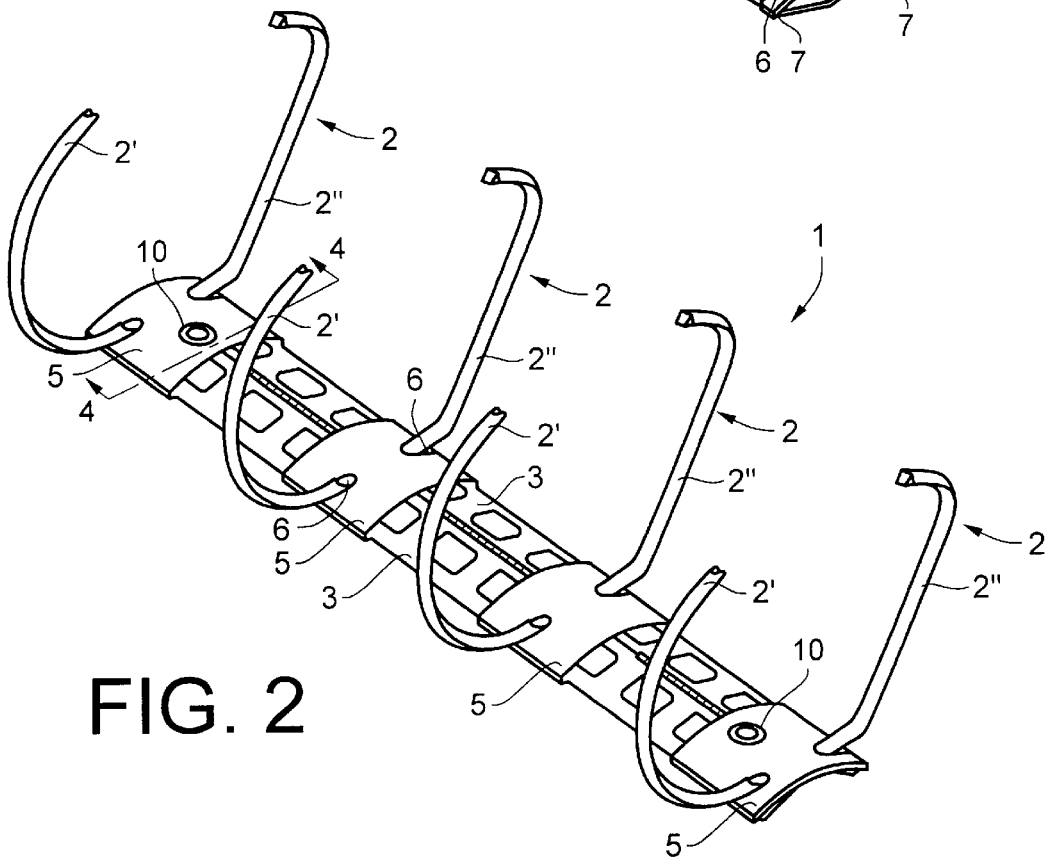
FIG. 2 is a perspective view of a ring binder according to the invention in an open position.
Figure 3:
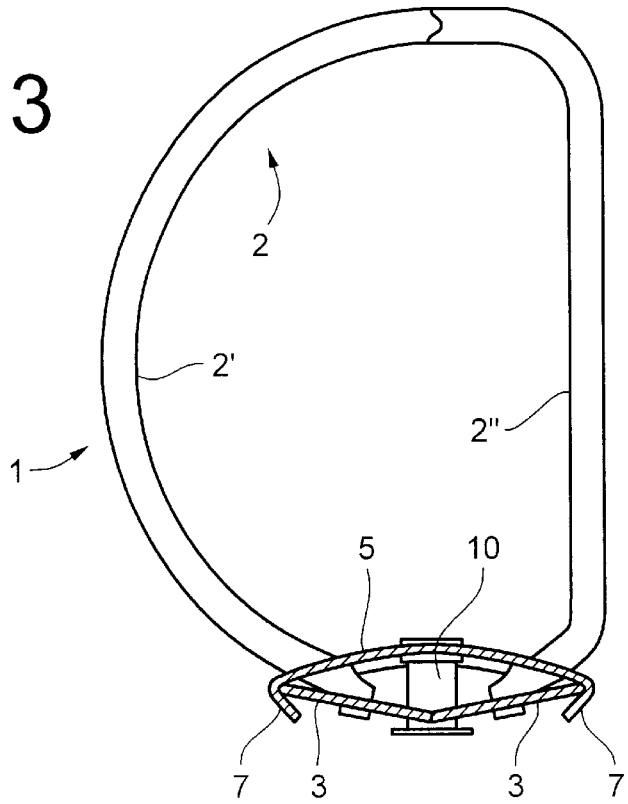
FIG. 3 is a cross-sectional view taken along line 3—3 of FIG. 1.
Figure 4:
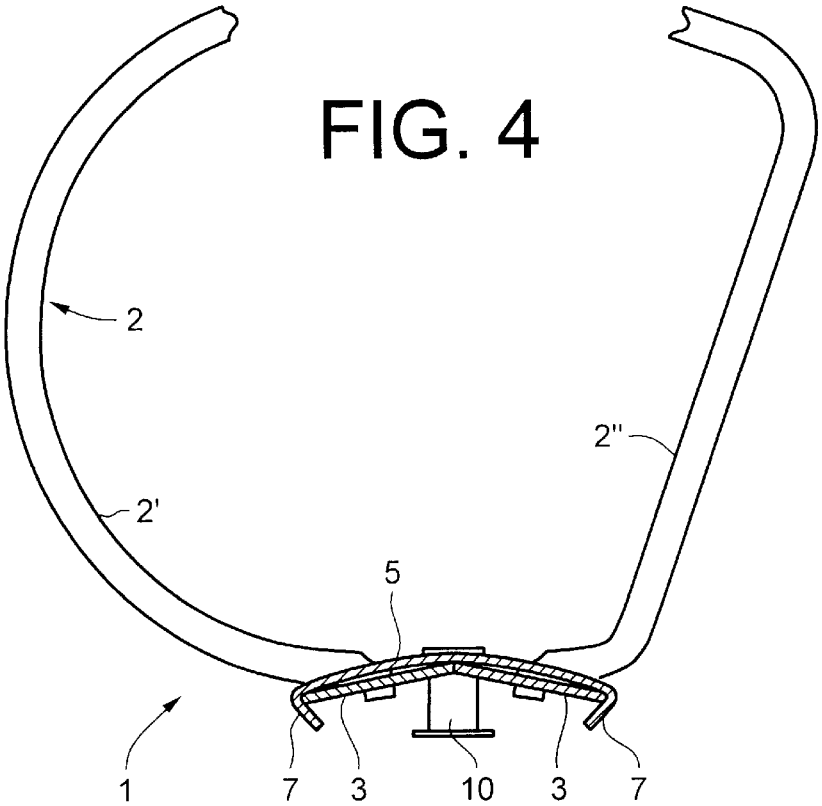
FIG. 4 is a cross-sectional view taken along line 4—4 of FIG. 2.
Figure 5:
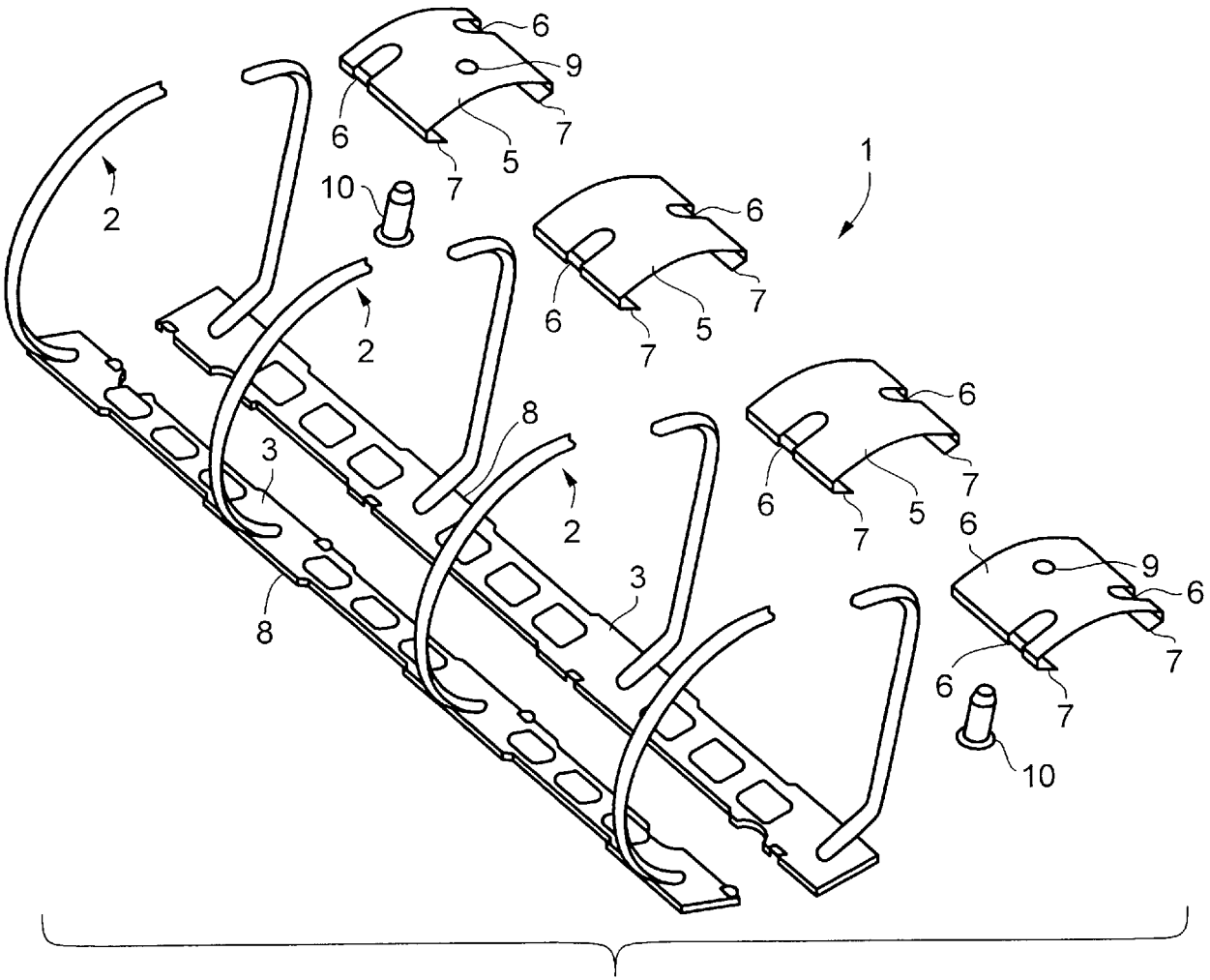
FIG. 5 is an exploded perspective view of the ring binder according to the invention.

Referring to the drawings, there is shown a ring binder 1 comprising a plurality of discrete housings 5 for an operating mechanism thereof. The ring binder is in the embodiment an elongate member having four rings 2 formed in the closed position by ring parts 2', 2", each of which is secured to a pivotable metal carrier plate 3 which are each strengthened by ribs 4. The plates 3 pivot against one another to an over-center position to spring the rings 2 open or close (FIGS. 4, 3).

In order to reduce material used for manufacture and to reduce the weight of the ring binder 1, a metal housing 5 is associated with each ring 2 which is convex in the embodiment. Each housing 5 has a pair of lateral blind slots 6 to accommodate pivotal movement of a respective ring part 2', 2", and has longitudinally folded over edges 7 which receive a part 8 of a respective carrier plate 3 and in which the part 8 pivots to effect opening and closing of the rings 2.

The housings 5 thus act as covers and are preferably spaced equidistantly along the ring binder 1. The housings 5 are spaced apart along a length of the carrier plate 3 such that gaps are formed between adjacent ones of the housings 3. An upper side surface of the carrier plate 3 is visible in areas of the gaps. Approximately one-half of said upper side surface of the carrier plate 3 is visible in the gaps between the housings 3. The gaps between adjacent ones of the housings 3 have a length which is greater than a length of each of said housings 3. A housing 5 is located at each end of the ring binder 1 which has a through hole 9 for receiving a hollow rivet 10 by which the ring binder 1 in use is mounted to a paper, plastic or cardboard binder cover such as a file, folder, folio, portfolio, or the like.

The carrier plates 3 and housings 5 may, it will be understood, be made of any suitable material, for example plastic. Also, there may be more, or fewer, than four rings 2, which can also be of any shape, such as circular.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ring binder comprising:

a plurality of rings;

an elongate operating mechanism secured to the rings for moving the rings between an open position and a closed position; and a plurality of separate housings for covering a portion of said operating mechanism, wherein said plurality of separate housings are spaced apart along a length of said elongate operating mechanism such that gaps are formed between adjacent ones of said housings, and an upper side surface of said operating mechanism is visible in areas of said gaps.

2. The ring binder according to claim 1, wherein three housings are provided.

3. The ring binder according to claim 1, wherein two of said housings are located one at each end of the elongate operating mechanism, and one or more of said housings are located intermediate the length thereof.

4. The ring binder according to claim 1, each housing being associated with a respective ring of the ring binder.

5. The ring binder according to claim 1, each housing comprising a slot for accommodating a respective ring part of said rings.

6. The ring binder according to claim 1, each housing comprising a seat part for receiving a portion of the operating mechanism.

7. The ring binder according to claim 6, the seat part comprising a folded edge of the housing to provide a bearing about which a pivotable carrier rack of the operating mechanism can pivot.

8. The ring binder according to claim 1, at least one of said housings including a fastener for securing the ring binder to a binder cover.

9. The ring binder according to claim 8, wherein the fastener comprises a hollow rivet.

10. A binder assembly comprising:

a cover member;

a ring binder secured to said cover member, said ring binder including:

a plurality of rings;

an elongate operating mechanism secured to the rings for moving the rings between an open position and a closed position; and a plurality of separate housings for covering a portion of said operating mechanism, wherein said plurality of separate housings are spaced apart along a length of said elongate operating mechanism such that gaps are formed between adjacent ones of said housings, and an upper side surface of said operating mechanism is visible in areas of said gaps.

11. The ring binder according to claim 1, wherein approximately one-half of said upper side surface of said operating mechanism is visible in said gaps between adjacent ones of said housings.

12. The ring binder according to claim 1, wherein each of said gaps between adjacent ones of said housings has a length which is greater than a length of each of said housings.

13. The binder assembly according to claim 10, wherein approximately one-half of said upper side surface of said operating mechanism is visible in said gaps between adjacent ones of said housings.

14. The binder assembly according to claim 10, wherein each of said gaps between adjacent ones of said housings has a length which is greater than a length of each of said housings.

15. The binder assembly according to claim 10, wherein two of said housings are located one at each end of the elongate operating mechanism, and one or more of said housings are located intermediate the length thereof.

16. The binder assembly according to claim 10, each housing comprising a seat part for receiving a portion of the operating mechanism.

17. The binder assembly according to claim 16, the seat part comprising a folded edge of the housing to provide a bearing about which a pivotable carrier rack of the operating mechanism can pivot.

18. The binder assembly according to claim 10, at least one of said housings including a fastener for securing the ring binder to said cover member.

* * * * *